United States Patent [19]

Smith

[11] 4,453,821

[45] Jun. 12, 1984

[54] SET-UP RECALL APPARATUS

[75] Inventor: Donald W. Smith, Rochester, N.Y.

[73] Assignee: Eastman Kodak Company, Rochester, N.Y.

[21] Appl. No.: 364,390

[22] Filed: Apr. 1, 1982

[51] Int. Cl.[3] ..... G03G 15/00

[52] U.S. Cl. ..... 355/14 C; 355/14 R

[58] Field of Search ..... 355/14 C, 14 R, 3 R, 355/40; 364/200, 300, 900; 235/304, 304.1

[56] References Cited

U.S. PATENT DOCUMENTS

| | | | |
|---|---|---|---|
| 3,940,210 | 2/1976 | Donohue | 355/14 |
| 4,035,072 | 7/1977 | Deetz et al. | 355/14 |
| 4,162,396 | 7/1979 | Howard et al. | 235/304 |
| 4,188,668 | 2/1980 | Finlay | 364/900 |
| 4,196,476 | 4/1980 | Steiner | 364/900 |
| 4,202,622 | 5/1980 | Kanatsura et al. | 355/14 C |
| 4,344,697 | 8/1982 | Matsumoto et al. | 355/14 C |

*Primary Examiner*—A. C. Prescott

*Attorney, Agent, or Firm*—William F. Noval

[57] ABSTRACT

Set-up recall apparatus for configuring a copier/duplicator prior to a production run includes a programmable, non-volatile memory which stores information corresponding to at least two different set-up configurations and a mechanism for selecting one of these configurations and for configuring the copier in accordance with such selected configuration.

6 Claims, 4 Drawing Figures

SET-UP RECALL APPARATUS

FIELD OF THE INVENTION

The present invention relates to apparatus for selecting features of a copier/duplicator prior to a production run.

BACKGROUND OF THE INVENTION

Description of the Prior Art

Present day copier/duplicators have a number of switch controlled features that can be selected by an operator such as paper supply (upper or lower), size reduction and copy exit location; if a recirculating feeder is used, collate or non-collate modes can be selected; and if a finisher is used, stapled or non-stapled copy sets can be selected. On certain copiers, there may be as many as sixteen or more operator selectable features. When power is turned on to a copier/duplicator, the general practice is to force the copier/duplicator into a predetermined configuration having selected features. In many work environments, there will be several frequently used machine configurations. In order to change from one of these configurations to another, an operator has to actuate a number of switches with an increasing likelihood of error as the number of switches that must be actuated increases.

SUMMARY OF THE INVENTION

In accordance with the invention, a programmable non-volatile memory stores information corresponding to at least two different copier set-up configurations. Prior to a production run, means are effective when actuated to select one of these configurations and to configure the copier in accordance with such selected configuration.

DESCRIPTION OF THE PREFERRED EMBODIMENT

To assist in understanding the present invention, it will be useful to consider an electrophotographic copier having a logic and control unit, and a recirculating document feeder. Whenever the term "document sheet" is used, it refers to particular mediums such as sheets having images to be copied. The term "document" refers to a plurality of document sheets that are to be copied during a production run. The term "copy" refers to the output of the copier such as a copy sheet having a fixed toner image.

Recirculating Feeder

Figure 1:
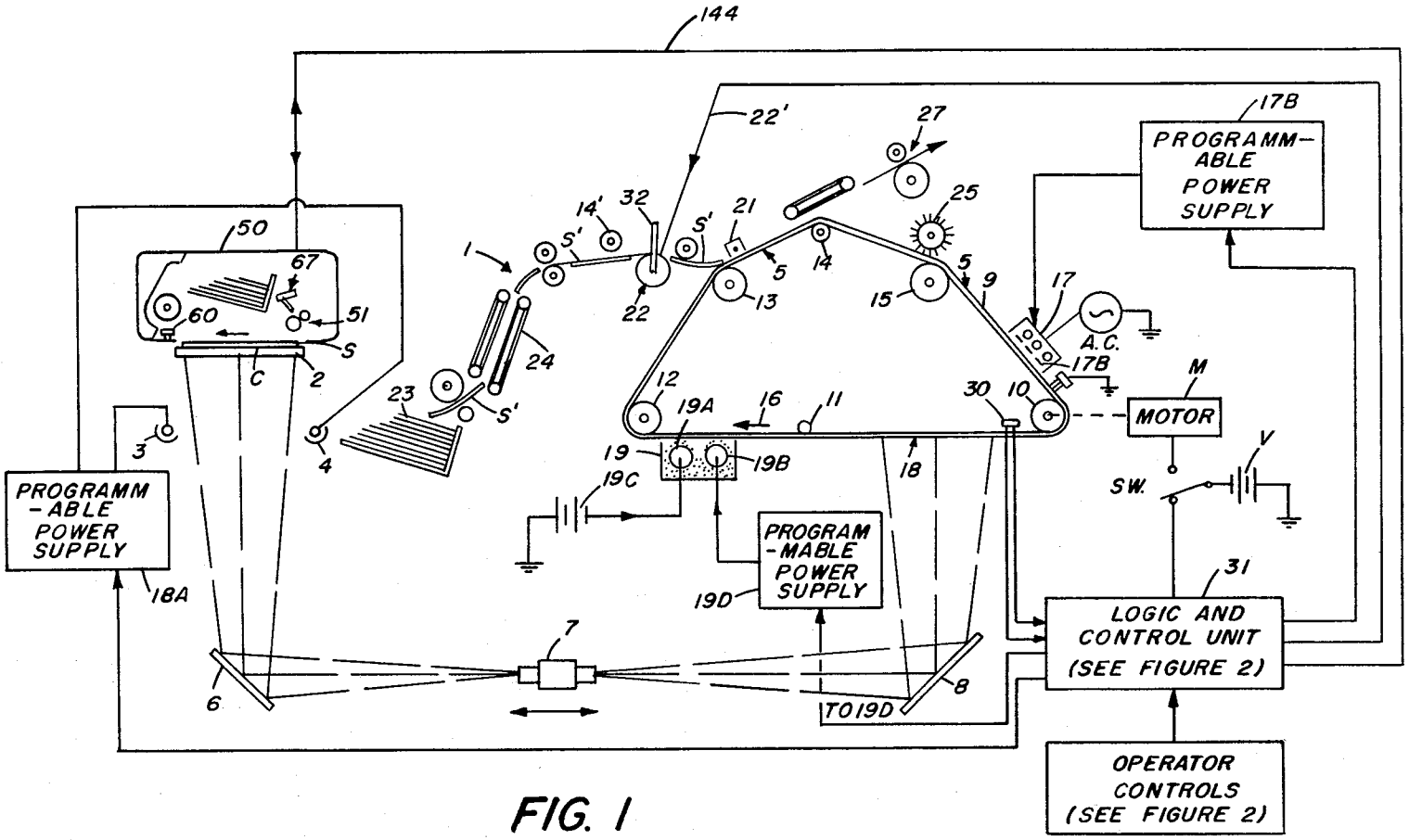
FIG. 1 is a schematic showing a side elevational view of a copier, feeder, and a logic and control unit in accordance with the invention.

In FIG. 1, a recirculating feeder 50 is positioned on top of an exposure platen 2 of a copier 1. The recirculating feeder may be similar to that disclosed in commonly assigned U.S. Pat. No. 4,076,408, issued Feb. 28, 1979, wherein a plurality of document sheets having images only on first sides of such sheets can be repeatedly fed seriatim from an originating document or stack to the exposure platen 2. It will be understood to those skilled in the art that a recirculating feeder that can be used with document sheets having images on both sides can also be used in accordance with this invention.

The feeder 50 includes feed rollers 51 which transport a document sheet S in direction of arrows 61 across the exposure platen 2 to document registration block 60, which stops and registers the document sheet on the exposure platens. The platen 2 is constructed of transparent glass. When energized, two xenon flashlamps 3 and 4 flash illuminate the document sheet S. By means of an object mirror 6, lens system 7, and an image mirror 8, an image of the illuminated document is optically stopped on discrete image areas of a moving photoconductor shown as a photoconductive web 5. By changing the position of the lens system 7, the magnification of a document sheet image can be changed. After a document sheet is illuminated, the block 60 is withdrawn from the path of travel of the documents and the document sheet is returned to the top of the document or stack in a tray. Leads 144 from feeder 50 provide inputs to and receive outputs from an LCU 31 to synchronize the operation of the feeder. For a more detailed disclosure of the operation of the feeder 50, see commonly assigned U.S. Pat. No. 4,099,860.

Electrophotographic Copier

The web 5 is an endless or continuous belt and is trained about six transport rollers 10, 11, 12, 13, 14, and 15. For more specific disclosures of such an arrangement, see commonly assigned U.S. Pat. Nos. 3,615,406 and 3,615,414, both issued Oct. 26, 1971. Roller 10 is coupled to a drive motor M in a conventional manner. Motor M is connected to a source of potential V when a switch SW is closed by the logic and control unit (LCU) 31. When the switch SW is closed, the roller 10 is driven by the motor M and moves the web 5 in a clockwise direction as indicated by arrow 16. This movement causes successive image areas of the web 5 to sequentially pass by a series of electrophotographic work stations of the copier.

For the purpose of the instant disclosure, several copier work stations are shown along the web's path. These stations will be briefly described. For more complete disclosures of them, see commonly assigned U.S. Pat. No. 3,914,047.

First, a charging station 17 is provided at which the photoconductive surface 9 of the web 5 is sensitized by applying to such surface an electrostatic charge of a predetermined voltage. The station 17 includes an A.C. charger shown as a three wire A.C. charger. The output of the charger is controlled by a grid connected to a programmable power supply 17B. The supply 17B is in turn controlled by the LCU 31 to adjust the voltage level Vo applied onto the surface 9 by the charger 17. For an example of digital regulation of a corona charger, see U.S. Pat. No. 4,166,690.

At exposure station 18, the inverse image of a document sheet S is projected onto the photoconductive surface 9 of the web 5. The image dissipates the electrostatic charge at the exposed areas of the photoconductive surface 9 and forms a latent electrostatic image. A programmable power supply 18A, under the supervision of the LCU 31, controls the intensity or duration of light incident upon the web 5 produced by the lamps 3 and 4. For a specific example of such an exposure station and programmable power supply, see commonly assigned U.S. Pat. No. 4,150,324, issued Aug. 8, 1978 to Seil.

A dual magnetic brush developing station 19 includes developer, having iron carrier particles and electroscopic toner particles with an electrostatic charge opposite to that of the latent electrostatic image. The developer is brushed over the photoconductive surface 9 of the web 5 and toner particles adhere to the latent electrostatic image to form a visible toner particle, transferable image. The dual-magnetic brush station 19 includes two rollers, a transport roller 19A, and a developer roller 19B. In the disclosed embodiment, conductive portions, such as the drive shaft and the application cylinder of the transport roller 19A, act as an electrode and are electrically connected to a source of fixed D.C. potential, shown as a battery 19C. Conductive portions of development roller 19B also act as an electrode and are electrically connected to a programmable power supply 19D controlled by the LCU 31. For a specific disclosure of a dual magnetic brush which can be used in accordance with the invention, see commonly assigned U.S. Pat. No. 3,543,720.

The copier 1 also includes a transfer station shown as a corona charger 21 at which the toner image on web 5 is transferred to a copy sheet S'; and a cleaning station 25, at which the photoconductive surface 9 is cleaned of any residual toner particles remaining after the electroscopic toner images have been transferred and any residual electrostatic is discharged.

As shown in FIG. 1, a copy sheet S' is fed from a supply 23 to continuously driven rollers 14 (only one of which is shown) which then urge the sheet against a rotating registration finger 32 of a copy sheet registration mechanism 22. This causes the sheet to buckle. When the finger rotates free of the sheet, the driving action of the rollers 14 and sheet buckle release cause the sheet to move forward onto the web 5 in alignment with a toner image at the transfer station 21.

After transfer of the unfixed electroscopic toner images to a copy sheet S', such sheet is transported to fuser 27 where the image is fixed to it.

To coordinate operation of the various work stations 17, 18, 19, 21, and 25 with movement of the image areas on the web 5 past these stations, the web has a plurality of perforations along one of its edges. These perforations generally are spaced equidistantly along the edge of the web. For example, the web 5 may be divided into six image areas by F perforations; and each image area may be subdivided into 51 sections by C perforations. The relationship of the F and C perforations to the image areas is disclosed in detail in commonly assigned U.S. Pat. No. 3,914,047. At a fixed location along the path of web movement, there is provided suitable means 30 for sensing web perforations. This sensing produces input signals into the LCU 31 which has a digital computer, preferably a microprocessor. The microprocessor has a stored program responsive to the input signals for sequentially actuating then de-actuacting the work stations as well as for controlling the operation of many other machine functions as disclosed in U.S. Pat. No. 3,914,047.

Logic and Control Unit (LCU)

Programming of a number of commercially available microprocessors such as INTEL model 8080 or model 8085 microprocessor (which along with others can be used in accordance with the invention), is a conventional skill well understood in the art. The following disclosure is written to enable a programmer having ordinary skill in the art to produce an appropriate control program for the microprocessor. The particular details of any such program would, of course, depend on the architecture of the designated microprocessor.

Figure 2:
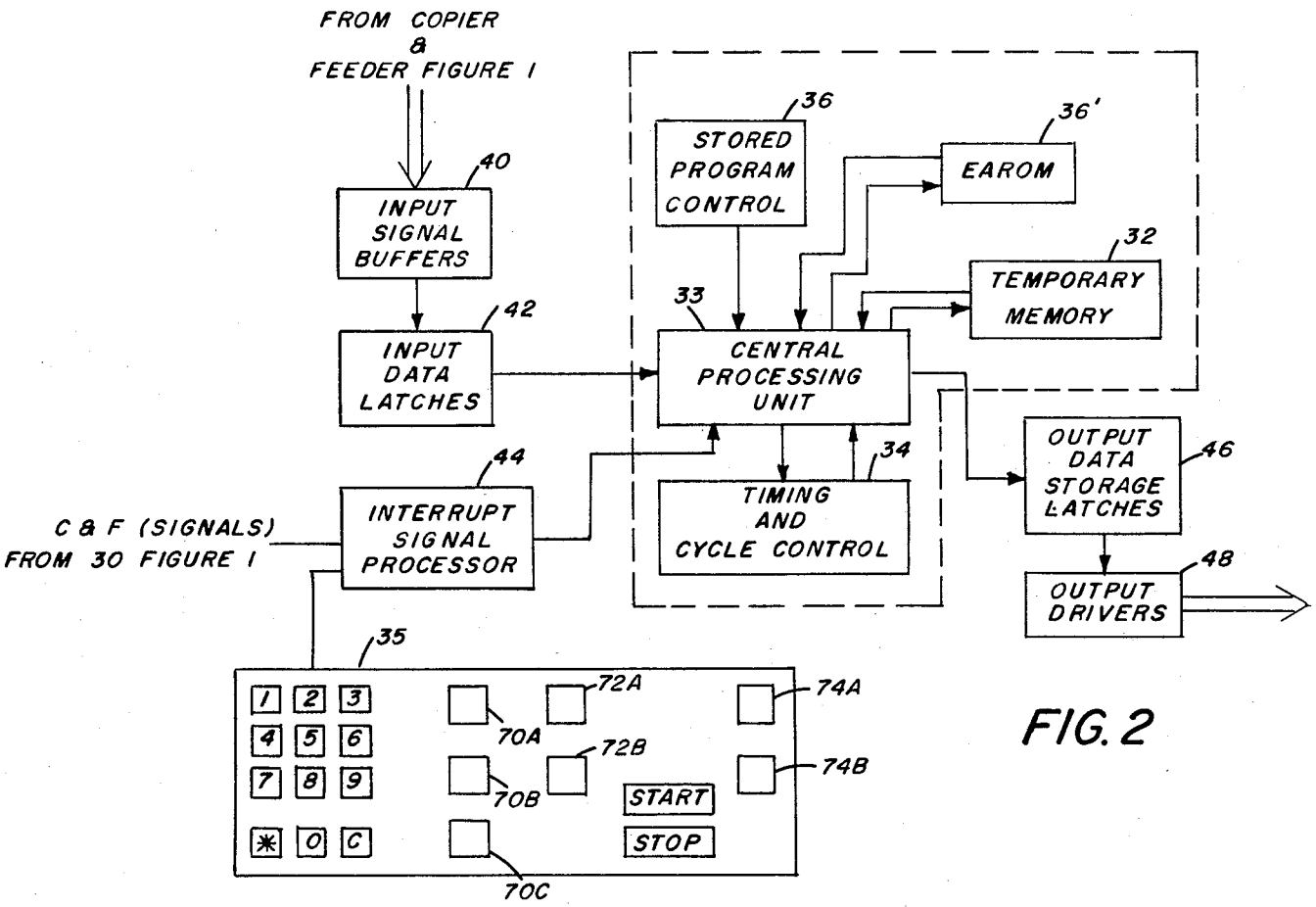
FIG. 2 is a block diagram of the logic and control unit shown in FIG. 1.

Turning now to FIG. 2, a block diagram of logic and control unit (LCU) 31 is shown which interfaces with the copier 1 and the feeder 50. The LCU 31 consists of temporary data storage memory 32, central processing unit 33, timing and cycle control unit 34, electrically alterable, non-volatile Read Only Memory (EAROM) 36' and stored program control 36 which can be provided by a non-alterable Read Only Memory (ROM).

The temporary storage memory 32 may be conveniently provided by a conventional Read/Write memory or Random Access Memory (RAM).

The ROM 36 contains operational programs in the form of binary words corresponding to instructions and values. These programs are permanently stored in the ROM and cannot be altered by the computer operation. Data stored in EAROM 36' can be changed as will be described later. Data input and output is performed sequentially under program control. Input data are applied either through input signal buffer 40 to input data latches 42 or to interrupt signal processor 44. The input signals are derived from various switches, sensors, and analog-to-digital converters. The output data and control signals are applied to storage latches 46 which provide inputs to suitable output drivers 48, directly coupled to leads. These leads are connected to various work stations. For example, as shown in FIG. 1, leads 144 are connected to feeder 50 and lead 22 is connected to the copy sheet registration feeding mechanism 22. EAROM 36' is coupled to the central processing unit 33. A keyboard 35 can be used to change the content of specific storage locations of memory 36'. The copier keyboard 35 is shown connected to the interrupt signal processor 44. Keyboard 35 can conveniently be located on the operator control panel of the copier/duplicator. The starred (*) button is used to add and/or recall setup configuration information from memory 36' as will be described.

On the keyboard 35 there are a number of touchpad switches which can be used by an operator to change the copier/duplicator configuration. For example, an operator can depress either button 70A for full-size copies, button 70B for 94%-size copies, or button 70C for 77%-size copies. Similarly, he can depress button 72A for a side exit or button 72B if he desires the recirculating feeder to operate in the collate mode or button 74B for the non-collate mode. A number of other operator selectable switches (not shown) can also be provided to select, for example, one of two or more paper supplies, finisher operations such as stapled or offset stacking, one- or two-sided copying, and/or contrast and density adjustments.

Let us assume a situation where an operator desires to store in EAROM 36' a frequently used copier configuration. The first thing he does is to press those touchpad switches shown on panel 35 which define the configuration such as, for example, switches 70B, 72A, and 74B. Within the ROM 36 (See FIG. 2) there are at least two stored programs for ordering memory locations in EAROM 36' to store different machine configurations.

Figure 3A:
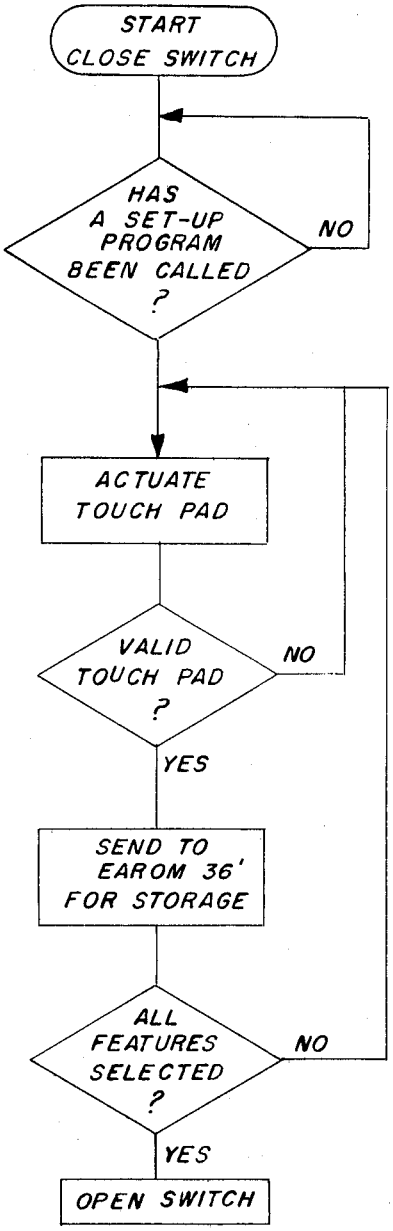
FIGS. 3A and 3B are flow charts of the operation of setup recall apparatus in accordance with the invention.

Let us assume further that one of these programs can be accessed from the keyboard 35 by depressing the touchpad switches * 0 705. Turning now to FIG. 3A, we see this situation in the form of a flowchart. The microprocessor 31 asks the questions "Has a set-up program been called?". Since switches * 0 705 were depressed, it has. It then checks to see whether valid touchpads have been depressed. For example, a "C" or "Start" or "Stop" would not be a valid configuration touchpad. If an invalid touchpad was depressed, an indication would be provided to the operator, requiring him to reconfigure the copier. If valid touchpads were selected, then the central processing unit causes the information represented by the depressed switches to be delivered through the interrupt signal processor 44, central processing unit 33 into the appropriate storage locations in EAROM 36'. This process may be repeated for entering other configurations. For example, if storage locations for a second configuration were needed, then an operator would call a second program by depressing touchpad switches say, for example, "* 0 706". After the FIG. 3A process is completed, there would be set up two different configurations in EAROM 36'.

Figure 3B:
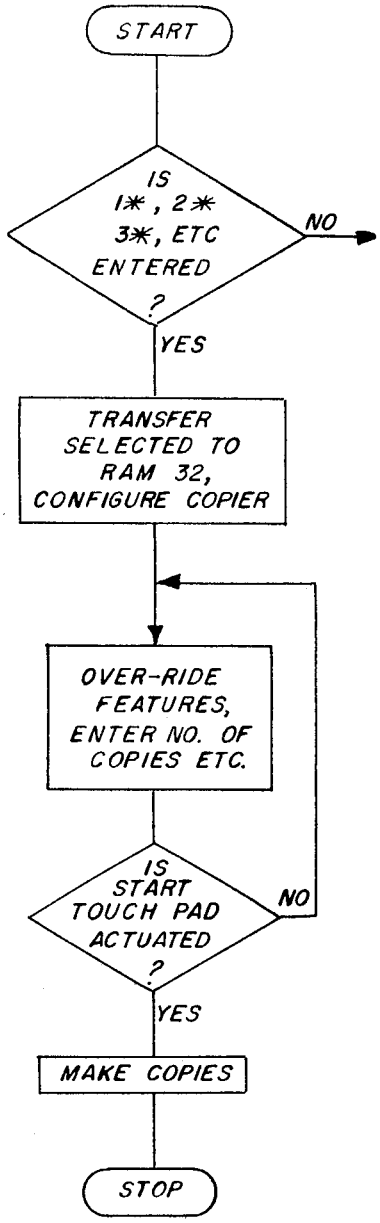

In order for an operator to selectively call up one of these configurations, he must depress appropriate keys on the keyboard 35. In our specific example, we will assume 1* calls up the first set-up configuration in EAROM 36'; and 2* the second. This process is shown in FIG. 3B. When an operator depresses 1*, it will be decoded in central processing unit which causes a duplicate of the first set-up configuration stored in EAROM 36' to be reproduced in temporary memory 32 where it is more readily accessed for computation work. The LCU 31 then causes the output drivers 48 to actuate particular mechanisms in the copier to configure the copier in the selected configuration. At this point, an operator can change or override any one of the selected switches. For example, if switch 72A were actuated, an operator could override this switch by depressing switch 72B. Also, a configuration could include the number of copies. If it doesn't, then the numerical keys must be depressed to enter the number of copies to be made. The operator must, of course, depress the start button to make the desired number of copies.

The invention has been described in detail with particular reference to preferred embodiments thereof, but it will be understood that variations and modifications can be effected within the spirit and scope of the invention.

What is claimed:

1. In a copier/duplicator having a keyboard capable when acutated by an operator to establish various set-up configurations so that the copier produces production runs in accordance with a selected set-up configuration of such copier/duplicator, set-up recall apparatus comprising:

(a) programmable non-volatile memory means;

(b) means coupled to said keyboard for storing in said non-volatile memory means when actuated by said operator information which corresponds to at least two different set-up configurations of said copier/duplicator;

(c) means effective when actuated by said operator for selecting a desired one of said stored set-up configurations to configure said copier/duplicator in accordance with such selected configurations prior to a production run.

2. The invention as set forth in claim 1 including means selective actuated by an operator for changing portions of a selected configuration prior to a production run.

3. In a copier/duplicator capable of a plurality of production runs having different operating functions in accordance with different set-up configurations of such copier/duplicator, set-up recall apparatus comprising:

a programmable computer for controlling the operation of said copier/duplicator;

said computer including programmable non-volatile memory means;

a keyboard including a plurality of operator actuatable switches for instructing said computer to configure the copier/duplicator for a production run having preselected operating functions;

means coupled to said keyboard for storing in said non-volatile memory upon actuation by an operator instructions which correspond to at least two different set-up configurations of said copier/duplicator; and means effective when actuated by an operator for recalling a desired one of said set-up configurations stored in said volatile memory means to configure said copier/duplicator in accordance with such selected configuration prior to a production run.

4. The apparatus of claim 3 wherein said keyboard includes a plurality of dedicated copier/duplicator operating function switches which when actuated provide instructions corresponding to the preselected function for a production run and further includes an operator actuatable program select switch (1) which is actuated by an operator after actuation of function switches relating to a set-up configuration to cause said storing means to store said configuration in said non-volatile memory means; and (2) which is actuated by an operator before a production run to cause said recall means to recall a selected set-up configuration to configure said copier/duplicator for said selected production run.

5. The apparatus of claim 3 wherein said keyboard includes a start switch which when actuated starts a production run of said copier/duplicator and wherein said recall means when actuated recalls the selected set-up configuration so that it is visible to an operator prior to a production run and including means for changing portions of a selected configuration prior to said run.

6. The apparatus of claim 3 wherein said computer includes a read-only memory including at least two stored programs for ordering memory locations in said programmable non-volatile memory to store a selected set-up configuration when said storing means is actuated.

* * * * *